US005261610A

United States Patent [19]

Waryu et al.

[11] Patent Number: 5,261,610

[45] Date of Patent: Nov. 16, 1993

[54] COATING DISPENSER WITH HYDRAULIC-ASSISTED VALVE CLOSURE

[75] Inventors: Joseph C. Waryu, Amherst; Thomas A. Loparo; Guy McMillan, both of Elyria, all of Ohio

[73] Assignee: Nordson Corporation, Westlake, Ohio

[21] Appl. No.: 838,150

[22] Filed: Feb. 18, 1992

Related U.S. Application Data

[63] Continuation-in-part of Ser. No. 584,463, Sep. 18, 1990, Pat. No. 5,078,325.

[51] Int. Cl.[5] ..... B05B 5/025

[52] U.S. Cl. ..... 239/585.4; 239/DIG. 14; 251/129.19; 251/129.21

[58] Field of Search ..... 239/585.1, 585.2, 585.4, 239/583, 584, 526, DIG. 14; 251/129.19, 129.21

[56] References Cited

U.S. PATENT DOCUMENTS

| | | | |
|---|---|---|---|
| 2,936,959 | 5/1960 | Nord et al. . | |
| 2,969,926 | 1/1961 | Peeps | 239/583 |
| 3,490,701 | 1/1970 | Malec | 239/584 |
| 3,583,632 | 6/1971 | Shaffer et al. | 239/583 |
| 3,633,828 | 1/1972 | Larson | 239/DIG. 14 |
| 3,690,518 | 9/1972 | Baker et al. . | |
| 3,731,145 | 5/1973 | Senay . | |
| 3,818,930 | 6/1974 | Crum et al. . | |
| 3,836,082 | 9/1974 | Krohn | 239/526 |
| 3,840,158 | 10/1974 | Baker et al. . | |
| 3,893,627 | 7/1975 | Siczek et al. | 239/583 |
| 3,960,296 | 6/1976 | Nord . | |
| 3,973,697 | 8/1976 | Crum et al. . | |
| 4,026,440 | 5/1977 | Crum et al. . | |
| 4,162,042 | 7/1979 | Mommsen et al. | 239/526 |
| 4,163,520 | 8/1979 | Garcin et al. . | |
| 4,241,880 | 12/1980 | Hastings . | |
| 4,266,721 | 5/1981 | Sickles . | |
| 4,273,293 | 6/1981 | Hastings . | |
| 4,335,851 | 6/1982 | Hastings . | |
| 4,381,081 | 4/1983 | Hastings . | |
| 4,430,886 | 2/1984 | Rood . | |
| 4,579,255 | 4/1986 | Frates et al. | 239/583 |
| 4,651,932 | 3/1987 | Huber et al. . | |
| 4,708,292 | 11/1987 | Gammons | 239/600 |
| 4,824,026 | 4/1989 | Tamura et al. . | |
| 4,886,013 | 12/1989 | Turner et al. . | |

OTHER PUBLICATIONS

"Electromatic X-Hot Melt Adhesive Applicator & Heated Spray Gun", Spraymation Inc., Fort Lauderdale, Fla.

"AA26AUH and AAP26AUH Electric Autojet Automatic Spray Guns", installation and maintenance instructions, Spraying Systems Co., Wheaton, Ill.

*Primary Examiner*—Andres Kashnikow
*Assistant Examiner*—Lesley D. Morris
*Attorney, Agent, or Firm*—Wood, Herron & Evans

[57] ABSTRACT

A coating dispenser such as a spray gun, which is particularly adapted for the application of a protective coating material onto metal can bodies, comprises a gun body formed with a liquid passageway which carries the valve stem of a needle valve. In the presently preferred embodiment, the lowermost end or valve tip of the needle valve, and a valve seat, are carried within a valve seat block which is secured to the base of the gun body. A threaded connection is provided between the valve tip in the valve seat block, and the valve stem within the gun body, so that the valve tip, valve seat and valve seat block can be removed and replaced as a unit when the valve tip and/or valve seat become worn. Structure is also provided to exert a combined spring force and hydraulic force on the needle valve in order to quickly and efficiently move it from an open position to a closed position relative to the valve seat.

14 Claims, 5 Drawing Sheets

COATING DISPENSER WITH HYDRAULIC-ASSISTED VALVE CLOSURE

RELATED APPLICATIONS

This is a continuation-in-part application of U.S. patent application Ser. No. 07/584,463, filed Sep. 18, 1990, entitled "Coating Dispenser With Removable Valve Tip and Valve Seat" to Waryu et al, which is owned by the same assignee as this invention and now U.S. Pat. No. 5,078,325.

FIELD OF THE INVENTION

This invention relates to coating dispensers for use in applying coating material in high speed production lines and, more particularly, to a coating dispenser having a hydraulically assisted closure for a valve assembly which includes a valve tip and valve seat removable as a unit or separately for repair or replacement without disturbing the coating supply line, electric and/or pneumatic lines and the mounting structure associated with the coating dispenser.

BACKGROUND OF THE INVENTION

A variety of products produced on high speed production lines require the application of coating material to form a protective layer thereon. For example, the production of metal cans involves dispensing a thin film of lacquer or other protective coating onto the can ends or can bodies to protect the contents of the can against metal contaminants. Commercially available lines for the production of metal cans run at speeds on the order of about 400 to 700 cans per minute, and for some applications a coating dispenser such as a spray gun must be turned on and off at the frequency of the cans moving past the spray gun.

Spray guns for coating the ends and/or interior of metal cans are disclosed, for example, in U.S. Pat. Nos. 4,886,013 and 4,430,886 which are owned by the assignee of this invention. Spray guns of this type have proven to be effective in applying the desired protective coating onto the ends and/or interior of metal cans, even at high line speeds, but the valve mechanism associated with such spray guns which starts and stops the flow of coating material to the cans eventually wears out after a large number of cycles. Periodically, the valve tip, valve seat, seals and other elements of the valve mechanism of the spray gun must be replaced because of wear.

Maintenance of the spray guns employed in high speed production lines such as can coating lines has been a problem in the past. The downtime required to repair or replace worn elements of spray guns is costly, particularly considering the high speed of operation of the production lines in which the spray guns are utilized. One solution to this problem has been to employ spray guns which are modular in construction to reduce the time required for the repair or replacement of various components of the coating apparatus, particularly the valve mechanism and associated seat which turns on and off the flow of coating material discharged from the gun.

One problem with spray guns of this type is that such repairs must be effected "off line", i.e., with the spray gun removed from the production line. This requires the coating supply lines, electric lines and/or air lines associated with the gun to be disconnected, as well as the mounting structure which retains the spray gun in position with respect to the object such as metal cans moving therepast. After the spray gun is repaired, it must then be reattached to the mounting structure and to the various supply lines before operation of the can production line can be resumed. These delays are costly and there is a need for reducing the time required for the repair or replacement of various parts of spray guns used in metal can manufacturing lines and other high volume production lines.

Another aspect of the performance of spray guns of the type disclosed in U.S. Pat. Nos. 4,886,013 and 4,430,886 is the speed with which the valve mechanism is closed, particularly after a relatively large number of cycles. In these spray guns, an armature is connected to the valve mechanism which is operative in response to activation of a solenoid to move the valve mechanism to an open position with respect to the discharge outlet of the spray gun. In order to move the valve mechanism to a closed position, the solenoid is de-energized allowing springs acting upon the armature and/or valve mechanism to return the valve mechanism to its original, closed position. One problem with this construction is that the return springs can fail to move the valve to a closed position quickly enough to avoid drooling or leakage of the coating material from the discharge outlet of the spray gun, particularly after a large number of on/off cycles. As a result, the coating material can be deposited onto areas of the cans and/or the production line where it is not desired.

SUMMARY OF THE INVENTION

It is therefore among the objectives of this invention to provide a coating dispenser, particularly for the application of protective coating material to metal cans, having a valve mechanism which is repairable or replaceable on-line, and, which is quickly closed even after a large number of on/off cycles.

These objectives are accomplished in a coating dispenser such as a spray gun which is particularly adapted for the application of a protective coating material onto metal can bodies comprising a gun body formed with a liquid passageway which carries the valve stem of a needle valve. In the preferred embodiment, the lowermost end or valve tip of the needle valve, and a valve seat, are carried within a valve seat block. A threaded connection is provided between the valve tip in the valve seat block, and the valve stem within the gun body, so that the valve tip and valve seat can be removed and replaced as a unit when either element becomes worn. Pins connected to the valve stem of the needle valve, and to its valve tip, are carried within slots formed in the gun body and valve seat block, respectively. These pins substantially prevent rotation of the valve stem and valve tip with respect to the gun body and valve seat block, respectively, when they are threaded into and out of engagement with one another.

In an alternative embodiment, the end of the valve stem is equipped with a collet which removably receives in a snap fit relationship a needle valve stem extension having a large ball formed on one end and a smaller ball formed on the other end. The larger ball snaps into the collet to secure the stem extension to the valve stem. The smaller ball comprises the needle valve end, and is engageable with a correspondingly formed valve seat which is carried in a valve seat holder or block. The valve seat block is secured to the gun body by a retaining nut. This design permits the needle valve stem extension and valve seat to be separately removed from the gun body without disturbing the placement of the gun body or remainder of the spray gun.

In either embodiment, one aspect of this invention is predicated upon the concept of permitting repair and/or replacement of the valve tip and associated valve seat of the spray gun, as a unit, or separately, without disturbing the remainder of the spray gun during the replacement process. The coating supply lines, electric or pneumatic lines and mounting structure for the spray gun can all remain in place as the valve tip and valve seat are removed and replaced. It has been found that the valve tip and valve seat elements are among the parts of the spray gun which are most susceptible to wear and/or failure, and thus it is desirable to permit their repair or replacement as quickly as possible and with the least amount of disruption to the production line.

In the presently preferred embodiment, the coating dispenser is a solenoid-operated spray gun having an armature axially moved in one direction by the coil of a solenoid which, in turn, moves the valve stem of the needle valve axially within the liquid passageway formed in the gun body. A roll pin is fixedly mounted to the valve stem of the needle valve and this roll pin is axially movable within a pair of slots formed adjacent to the liquid passageway in the gun body. The pin permits axial motion of the valve stem along the liquid passageway, but rotation of the valve stem with respect to the gun body is substantially prevented. Similarly, a roll pin is fixedly mounted to the valve tip in the valve seat block, and this pin is axially movable within a pair of slots formed on either side of a discharge outlet in the valve seat block. Rotation of the valve tip relative to the valve seat block is substantially prevented by this roll pin.

The upper end of the valve tip is formed with a bore having internal threads which are matable with external threads formed on an extension at the base of the valve stem of the needle valve. In order to connect the valve seat block which carries the valve tip onto the gun body, the valve tip is first threaded onto the extension of the valve stem. The roll pins associated with the valve stem and valve tip prevent their rotation within the gun body and valve seat block, respectively, so that the valve tip and valve stem can be assembled. As the valve stem and valve tip of the needle valve are threaded together, the valve seat block is moved near an extension formed at the base of the gun body. This extension includes one or more locking pins engageable with corresponding slots formed at the top of the valve seat block which prevent rotation of the valve seat block as it is secured into place against the extension of the gun body by a retaining nut.

With the valve seat block in place against the extension of the gun body, the discharge bore in the interior of the valve seat block communicates with the liquid passageway in the gun body forming a path for the flow of coating material from the gun body into the valve seat block. Flow of coating material from the discharge bore of the valve seat block is controlled by movement of the valve tip between an open and closed position relative to the valve seat. In the presently preferred embodiment, the valve tip has a ball-shaped end, and the valve seat is correspondingly formed. In the open position, coating material is permitted to flow through the valve seat and into the discharge outlet of a nozzle which is connected by a nozzle nut to the base of the valve seat block.

In another aspect of this invention, an improvement is provided relating to movement of the needle valve to a closed position quickly enough to substantially avoid leakage or drooling of the coating material from the discharge bore of the valve seat block. The solenoid-operated spray gun herein includes a return spring engageable with the armature and a return spring engageable with the needle valve which operate when the solenoid is de-energized to move the needle valve to a closed position with respect to the discharge bore in the valve seat block. In the past, these return springs were the only means of moving the needle valve to its closed position, and often were incapable of seating the needle valve before at least some coating material leaked or drooled through the discharge outlet of the spray gun. Because the spring force exerted by such springs must be overcome by the armature to open the spray gun, merely using springs with greater spring force to lessen closure time is unacceptable. This is because the time required to unseat the needle valve, or open time, would correspondingly increase since the armature would have to overcome a greater spring force in order to lift the valve tip from its seat.

In the presently preferred embodiment, structure is provided to hydraulically assist closure of the needle valve quickly and efficiently. Preferably, the armature is formed with a central throughbore which receives the valve stem of the needle valve therein, and four recesses or flutes which extend radially inwardly from the outer surface of the armature and are spaced 90° apart. The outer surface of the armature is movable within a bore formed in an armature sleeve which mounts the solenoid to the gun body. A flow path is created between the internal wall defined by the bore in the armature sleeve, and the outer wall and flutes of the armature, which extends from the base of the flutes to the top of the throughbore in the armature.

In order to induce a flow of the coating material upwardly along this flow path and then downwardly into the bore of the armature, a fluid guide is provided which is formed with an inlet connected at one end to a coating passageway in the gun body and a discharge slot or groove communicating with the flow path between the armature and armature sleeve. The fluid guide extends to a position relative to the outer wall of the armature wherein an upper portion of the fluid guide overlies at least a portion of the flutes in the armature, and a lower portion of the fluid guide extends proximate the outer wall of the armature below the flutes. In this position, the diametral gap or space between the fluid guide and the armature wall below the flutes is less than the diametral space between the fluid guide and the armature wall where the flutes begin. As a result, the coating material is induced to flow upwardly within the flutes, and along the small clearance space between the armature and internal wall of the armature sleeve, to the top of the bore in the armature, i.e., taking the path of least resistance.

The presence of the fluid guide results in the creation of a hydraulic force against the top of the armature and the top of the needle valve which assists the return springs in moving the needle valve to a closed position with respect to the discharge bore in the valve seat block. Because the fluid guide substantially prevents the passage of coating material directly from the inlet of the gun body into its liquid passageway toward the discharge port, essentially all of the coating material must first move to the top of the armature and to the top of the needle valve carried within the throughbore of the armature before being emitted from the discharge bore. The coating material, delivered under relatively high pressure, exerts a hydraulic force against the armature and against the needle valve which urges both members in a direction toward the discharge bore of the valve seat block. This hydraulic force augments the spring force exerted by the return springs on the armature and needle valve thus creating a net force which quickly and positively seats the needle valve against the valve seat within the valve seat block to stop the flow of coating material before it is permitted to leak or drool out of the discharge bore.

DESCRIPTION OF THE DRAWINGS

The structure, operation and advantages of the presently preferred and alternative embodiments of this invention will become further apparent upon consideration of the following description, taken in conjunction with the accompanying drawings, wherein.

DETAILED DESCRIPTION OF THE INVENTION

Figure 1:
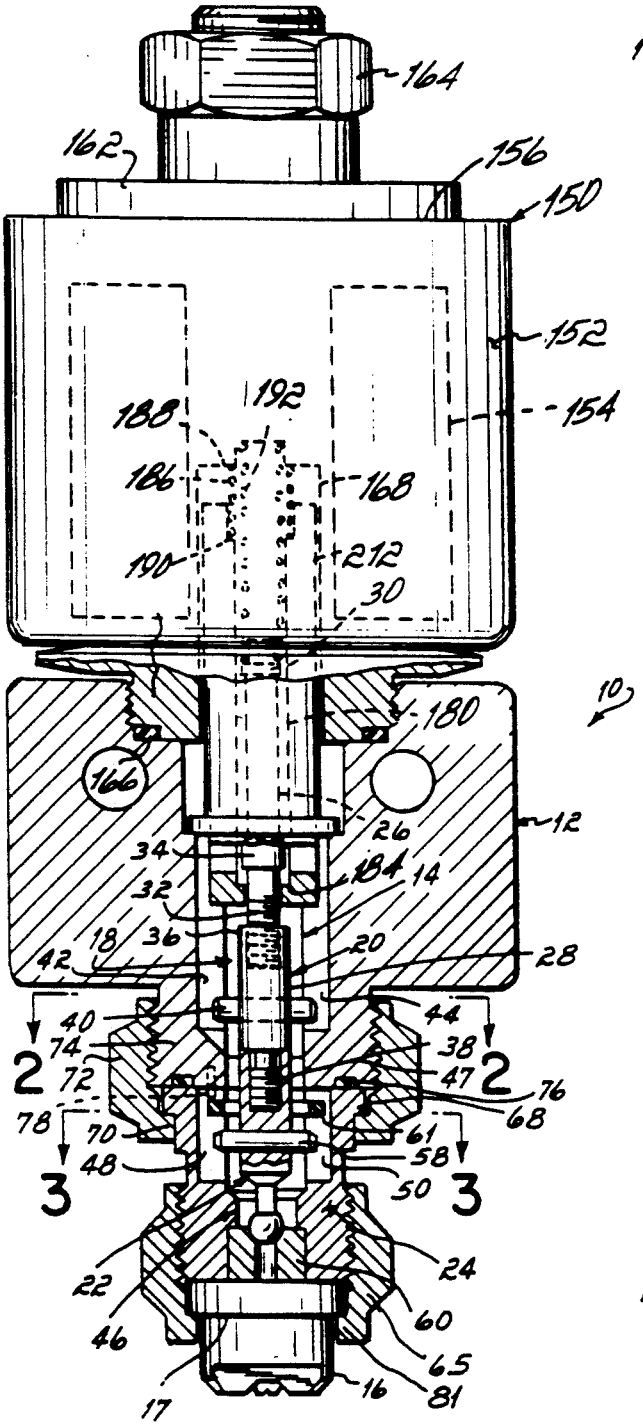
FIG. 1 is an assembled elevational view, in partial cross section, of a spray gun employing the removable valve seat block of the preferred embodiment of this invention.

Referring now to FIG. 1 which shows the presently preferred embodiment, a spray gun 10 is illustrated which generally comprises a gun body 12 formed with a liquid passageway 14 which discharges liquid coating material through a nozzle 16 communicating with the body 12. A needle valve 18 is axially movable within the liquid passageway 14 to control the flow of liquid to the nozzle 16. One aspect of this invention is directed to the construction of the lower portion of the spray gun 10, and to the needle valve 18.

The needle valve 18 is formed with a two-piece valve stem 20 carried within the liquid passageway 14 of dispenser body 12, and a valve tip 22 carried within a valve seat block 24 as described below. The valve stem 20 includes an upper portion 26 and a lower portion 28 which are axially movable along the liquid passageway 14, as described in more detail below. The upper portion 26 of valve stem 20 has a flange 30 mounted to its top end, a threaded lower end 32 and a sleeve 34 located intermediate the flange 30 and threaded lower end 32. The lower portion 28 of valve stem 20 is tubular in shape having an internally threaded upper end 36 and a lower end which mounts a threaded extension 38. The upper and lower portions 26, 28 of the valve stem 20 are interconnected to one another by threading the lower end 32 of upper portion 26 into the internally threaded upper end 36 of the lower portion 28.

In the presently preferred embodiment, a roll pin 40 is fixedly mounted to the lower portion 28 of valve stem 20. A pair of opposed, longitudinally extending slots 42 and 44 are formed in the dispenser body 12 on either side of the liquid passageway 14, each of which receive one end of the roll pin 40 mounted to the valve stem 20. The roll pin 40 is axially movable within the slots 42, 44 as the valve stem 20 is reciprocated within the liquid passageway 14, as described below. But rotation of the valve stem 20 with respect to the dispenser body 12 is substantially prevented by engagement of the ends of the roll pin 40 with the edges of slots 42, 44, for purposes to become apparent below.

Referring now to the lower portion of FIG. 1, and FIGS. 2-5, the construction of the valve seat block 24 of this invention is illustrated in detail. The valve seat block 24 is formed with a stepped throughbore 46 and a pair of longitudinally extending slots 48 and 50 on either side of the throughbore 46. The valve tip 22 of needle valve 18 is located within the stepped throughbore 46 and is formed with an internally threaded bore 47 at its upper end which is matable with the threaded extension 38 of valve stem 20, as described below. The lower end of valve tip 22 which comprises the needle valve end is ball-shaped and is engageable with a correspondingly formed valve seat 60. A roll pin 58 is fixedly mounted to the valve tip 22, and the opposed ends of this roll pin 58 extend within the slots 48, 50 adjacent to the stepped throughbore 46. The roll pin 58 permits axial movement of the valve tip 22 along the stepped throughbore 46 with respect to a valve seat 60 mounted to or integrally formed with the valve seat block 24 at the base of throughbore 46. Rotation of the valve tip 22 relative to the valve seat block 24 is substantially prevented, however, by engagement of the roll pin 58 with the edges of the slots 48, 50 in valve seat block 24.

Preferably, the valve tip 22 is retained within the stepped throughbore 46 by an O-ring 61 which is interposed between an overhanging, annular flange 62 formed at the top of the valve seat block 24, and the roll pin 58. The flange 62 is formed with opposed slots 63, 64 which permit insertion of the ring 61 within the interior of the valve seat block 24, in between the flange 62 and roll pin 58. In the event of an upward movement of the valve tip 22, the ring 61 engages the overhanging flange 62 and the roll pin 58 contacts the ring 61, thus retaining the valve tip 22 within the valve seat block 24.

The lower portion of the wall of valve seat block 24 is formed with external threads which are adapted to mate with the internal threads of a nozzle nut 65. The upper portion of the wall of valve seat block 24 is formed with flats 66 adapted to receive a tool such as a wrench, and an annular shoulder 68 which provides a seat for the lower flange 70 of a retaining nut 72. This retaining nut 72 has internal threads which engage the external threads of a dispenser body extension 74 projecting downwardly from the base of dispenser body 12. Preferably, the extension 74 has a recess which carries an O-ring 76 engageable with the top surface of valve seat block 24. At least two locking pins 78 project downwardly from the extension 74 which are engageable with slots 80 formed at the top end of the valve seat block 24. See FIGS. 4 and 5.

Figure 4:
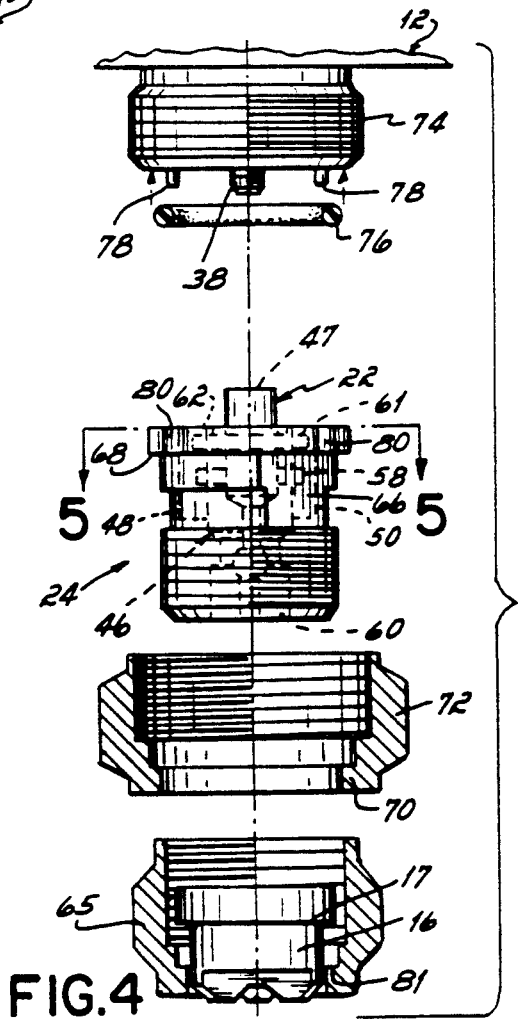
FIG. 4 is a disassembled, elevational view in partial cross section of the lowermost portion of the coating dispenser shown in FIG. 1.
Figure 5:
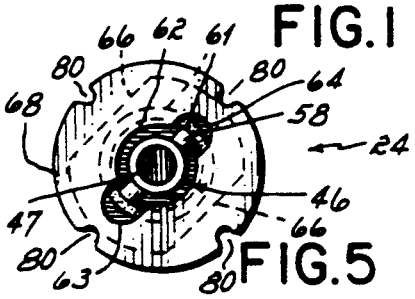
FIG. 5 is a plan view taken generally along line 5—5 of FIG. 4.

One important aspect of this invention is that the valve seat block 24, including the valve tip 22 and valve seat 60, can be assembled and disassembled as a unit from the dispenser body 12 quickly and easily and without disturbing the remainder of the spray gun 10. With reference to FIGS. 1 and 4, an assembly operation proceeds as follows. Initially, a new O-ring 76 is inserted within the recess at the base of the dispenser body extension 74 to ensure a fluid-tight seal is created between the extension 74 and the valve seat block 24. The valve tip 22 is then threaded onto the valve stem 20 of needle valve 18 by engagement of the threaded extension 38 of the lower portion 28 of valve stem 20 with the internally threaded bore 47 at the top end of the valve tip 22. The flats 66 on the outside of valve seat block 24 can be utilized to assist in threading the valve tip 22 and valve stem 20 together using a tool such as a wrench (not shown). As described above, the valve stem 20 is substantially prevented from rotating within the gun body 12 because of the engagement of roll pin 40 with the edges of slots 42, 44 in the gun body 12, and the valve tip 22 is substantially prevented from rotating within the valve seat block 24 because of the engagement of roll pin 58 with the slots 48, 50 in the valve seat block 24. With the valve stem 20 and valve tip 22 thus maintained rotatably fixed relative to the gun body 12 and the valve seat block 24, the interconnection of the valve stem 20 and valve tip 22 can proceed until the top surface of the valve tip 22 engages the bottom surface of valve stem 20. In this position, the top of valve seat block 24 is located adjacent the dispenser body extension 74, with the O-ring 76 interposed therebetween. As viewed in FIG. 1, the extension 38 of the valve stem 20 is allowed to bottom out against the base of the threaded bore 47 in the valve tip 22, before the valve seat block 24 contacts the dispenser body extension 74, due to the axial movement of the valve stem 20 which is permitted within the liquid passageway 14.

Figure 2:
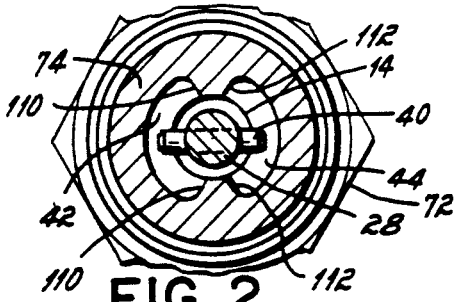
FIG. 2 is a cross sectional view taken generally along line 2—2 of FIG. 1.
Figure 3:
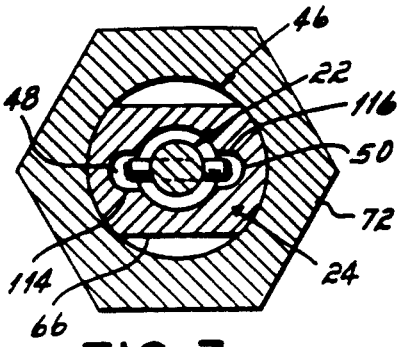
FIG. 3 is a cross sectional view taken generally along line 3—3 of FIG. 1.

As viewed in FIGS. 2 and 3, the slots 42, 44 in the gun body 12, and, to a lesser extent, the slots 48, 50 in the valve seat block 24, are larger in dimension than the diameter of the roll pins 40 and 58, respectively. That is, the dimension or distance between the opposed edges 110 and 112 of each slot 42, 44 in gun body 12 is greater than the diameter of roll pin 40, and the distance between the opposed edges 114 and 116 of each slot 48, 50 in the valve seat block 24 is greater than the diameter of roll pin 58. Limited rotation of the roll pin 40 within slots 42 and 44 in the gun body 10, and limited rotation of the roll pin 58 within slots 48 and 50 in the valve seat block 24, is thus permitted so that the locking pins 78 at the base of dispenser body extension 74 can be inserted within the slots 80 formed in the top of valve seat block 24.

In order to mount the valve seat block 24 onto the dispenser body extension 74, the retaining nut 72 is threaded onto the dispenser body extension 74 so that the lower flange 70 at the base of retaining nut 72 engages the annular shoulder 68 in the valve seat block 24. As the retaining nut 72 is tightened, the locking pins 78 prevent rotation of the valve seat block 24 relative to the dispenser body 12 thus allowing the valve seat block 24 to firmly seat against the dispenser body extension 74 and O-ring 76. Assembly is completed by affixing the nozzle 16 to the base of valve seat block 24 by engagement of the nozzle nut 65 with the external threads along the lower portion of valve seat block 24. As viewed in FIGS. 1 and 4, the nozzle 16 is preferably formed with a shoulder 17 which engages an annular flange 81 at the base of the nozzle nut 65 to retain the nozzle 16 upon the base of valve seat block 24.

Disassembly of the valve seat block 24 from the gun body 12 is accomplished by essentially reversing the above-described operation. The nozzle nut 65 is first disconnected from the valve seat block 24 which disengages the nozzle 16 therefrom. The retaining nut 72 is then unthreaded from the dispenser body extension 74 which exposes the flats 66 formed in the valve seat block 24. In order to disengage the alignment pins 78 from the alignment slots 80 at the top of the valve seat block 24, the valve seat block 24 and needle valve 18 is pulled downwardly a short distance by hand. Using the flats 66 and a wrench, the valve seat block 24 can be rotated to unthread the valve tip 22 from the valve stem 20 and thus disengage the valve seat block 24 from the gun body 12.

Figure 6:
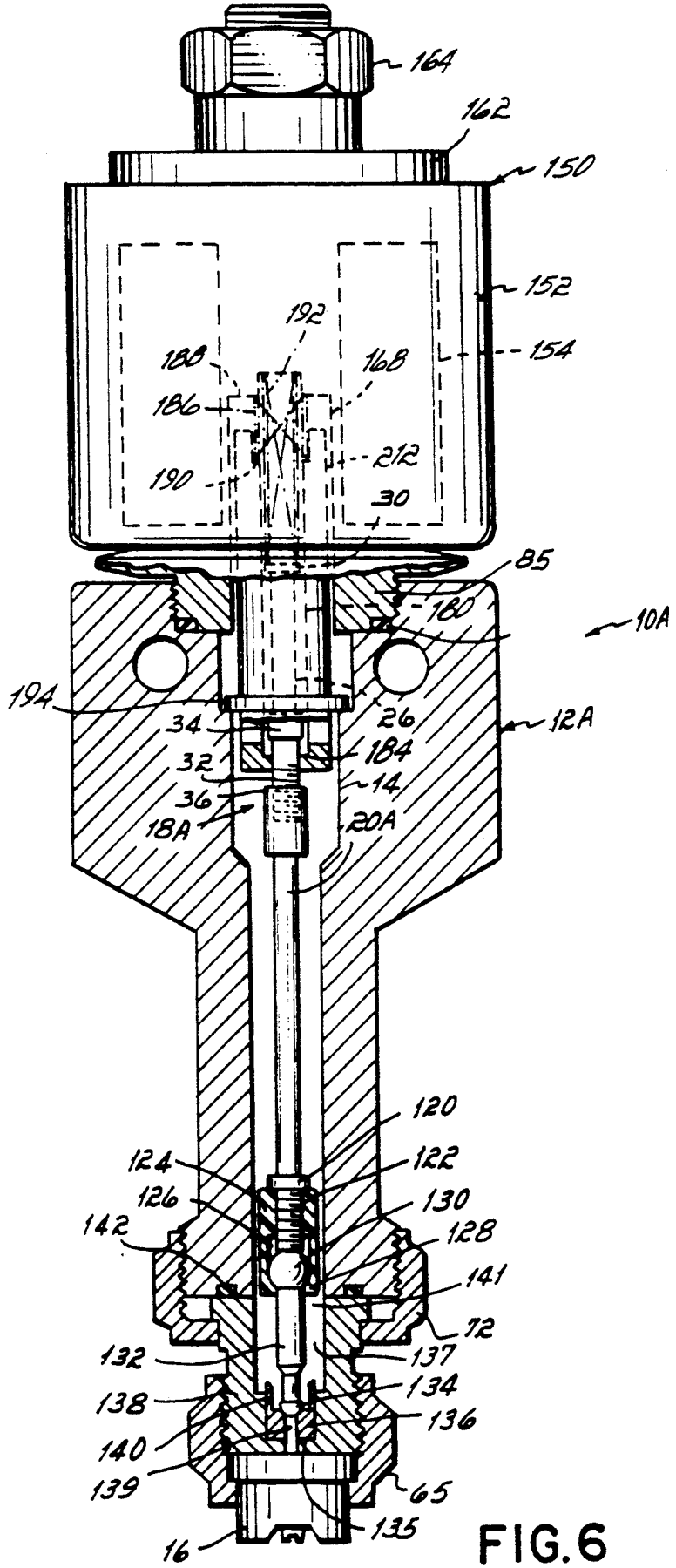
FIG. 6 is an assembled elevational view, in cross section, of an alternative embodiment of this invention.

With reference to FIG. 6, an alternative embodiment of this invention is illustrated which is similar in many respects to the embodiment of FIGS. 1-5 except for the removal and replacement of the valve seat and valve tip. As described in connection with FIGS. 1-5, repair or replacement of the valve tip 22 and valve seat 60 is accomplished by unthreading the valve tip 22 from the valve stem 20 so that the valve seat block 24, valve tip 22 and valve seat 60 can be removed as a unit from the remainder of the gun body 12. In the embodiment of FIG. 6, such repair or replacement of the valve seat and valve tip is accomplished somewhat differently, but with the same objective of permitting repair and replacement thereof while the dispenser body 12 is on-line.

As illustrated in FIG. 6, the valve stem 20A is secured to the lower end 32 of sleeve 34 in the same manner as described above in FIG. 1, but the lower portion of valve stem 20A has a shoulder 120 and a threaded end 122 which mates with internal threads formed in a collet 124. The collet 124 is threaded onto the end 122 of valve stem 20A until it engages the shoulder 120. In the presently preferred embodiment, the collet 124 has a hollow interior 126 and a radially inwardly extending flange 128 at the entrance to the interior 126. This flange 128, and the walls of collet 124, are at least partially elastically deformed to receive a large ball end 130 of a needle valve extension 132. Preferably, the collet 124 is formed of a plastic material which exhibits sufficient elasticity to deform and receive the ball end 130, but retain it in place on the lower end of valve stem 20A.

The opposite end of the needle valve extension 132 is formed with a smaller ball 134 which engages a mating seat 136 mounted at the outlet 135 of a passageway 137 formed in a valve seat block 138. The valve seat 136 includes a bore 139 and an upstanding collar 140 having an internal diameter which is greater than the diameter of ball 134. In the course of extension and retraction of plunger 20A, as described above, the collar 140 guides the ball end 134 so that it remains axially aligned with the valve seat 136. The valve seat block 138 is mounted to the gun body 12A against an O-ring 142 by a retaining nut 72 in the same manner as valve seat block 24 described in connection with FIG. 1, so that the inlet 141 of its passageway 137 communicates with the passageway 14 in gun body 12A. A nozzle 16 is mounted to the valve seat block 138 with a nozzle nut 65 as also described above.

The above-described construction of the embodiment of FIG. 6 permits easy, on-line removal of both the valve seat 136 and needle valve extension 132 for repair or replacement as required. In order to remove the valve seat 136, the retaining nut 72 is unthreaded to disengage the valve seat block 138 from the gun body 12A while the needle valve extension 132 remains connected to the collet 124 carried in the gun body 12A by the needle valve 20A. Preferably, the valve seat 136 and valve seat block 138 are fixedly mounted to one another and are removed and replaced as a unit.

Once the valve seat block 138 has been disconnected from the gun body 12A, the needle valve extension 132 can also be removed for repair or replacement. Preferably, the center portion of the needle valve extension 132, between the ball ends 130 and 134, is gripped with a tool such as vise grips or the like and pulled downwardly out of the collet 124 which separates it from the gun body 12A. It is contemplated that notches or other flats could be milled into opposite sides of the needle valve extension 132 between the balls 130 and 134 to facilitate gripping of the needle valve extension 13 to permit easier removal of the needle valve extension 132. A new needle valve extension 132 is installed by forcing the large ball end 130 into the collet 124 and then reattaching a new valve seat block 138 and valve seat 136 unit.

Having described the preferred and alternative embodiments of one aspect of this invention, it can be appreciated that both the assembly and disassembly operations can be accomplished in either embodiment without disturbing the mounting structure which positions the gun body 12 relative to a metal can production line (not shown), or requiring disconnection of any fluid or electrical lines to the gun body 12 or 12A. Repair or replacement of the valve tip 22 and valve seat 60, or valve tip extension 132 and valve seat 136, is accomplished with the dispenser body 12 or 12A on-line, and thus a minimum amount of disruption to the can coating or other production line is created.

With reference to FIGS. 7–10, a modified spray gun 10B is illustrated which includes structure for reciprocating needle valve 18 with respect to the valve seat 60 of the type shown in FIGS. 1–6. Alternatively, the spray gun 10B can incorporate the needle valve 18A and valve seat 136 described above in connection with a discussion of FIG. 6. This structure for reciprocating valve 18, 18A is shown schematically in FIGS. 1 and 6, and the same reference numbers used to describe the detailed structure discussed below are also shown in FIGS. 1 and 6.

In each embodiment of this invention, the gun body 12 mounts a solenoid 150 having a housing 152 which contains a coil 154 retained therein by a cap 156 threaded into the top of housing 152. As used herein, the terms "top" and "bottom" refer to the vertical orientation of spray gun 10B depicted in FIGS. 7 and 8. The housing 152 and cap 156 are formed with a central bore 153, and one side of the housing 152 is formed with a threaded inlet 155. An armature sleeve 158 extends through the coil 154 and bore 153, and is formed with a threaded upper end 160 which mounts a housing nut 162 atop the cap 156. The housing nut 162 is held in place by a jam nut 164. The lower end of armature sleeve 158 is threaded into a bore formed in the gun body 12 with an O-ring 166 located between.

Figure 10:
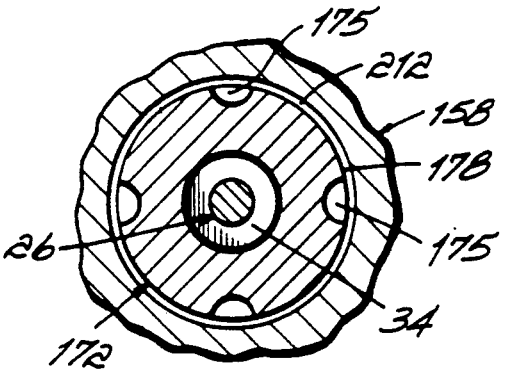
FIG. 10 is a plan view, in partial cross section, of the fluid guide, valve stem and a sleeve.

In the presently preferred embodiment, the armature sleeve 158 is formed with a bore 168 defining an inner wall 170. With the armature sleeve 158 mounted to the gun body 12, the bore 168 in armature sleeve 158 connects to the fluid passageway 14 in the gun body 12. The armature sleeve 158 receives a tubular-shaped armature 172 which extends at least partially into the coil 154 of solenoid 150. The armature 172 has a top end 174, a bottom end 176 and an outer surface 178. As shown in FIG. 10, the armature 172 is formed with four semicircular-shaped recesses or flutes 175, spaced approximately 90° apart, which extend radially inwardly from the outer surface 178. These flutes 175 also extend vertically along the armature 172, and each include an inlet end 177 which is located vertically above the bottom end 176 of armature 172 and an outlet end 179 at the top end 174 of armature 172. The armature 172 is also formed with a bore 180 which extends from its top end 174 toward the bottom end 176 where it intersects a number of radially outwardly extending passages 182. These passages 182, and the bottom end 176 of armature 172, are located within the fluid passageway 14 of gun body 12 to discharge coating material therein as described in more detail below.

Figure 7:
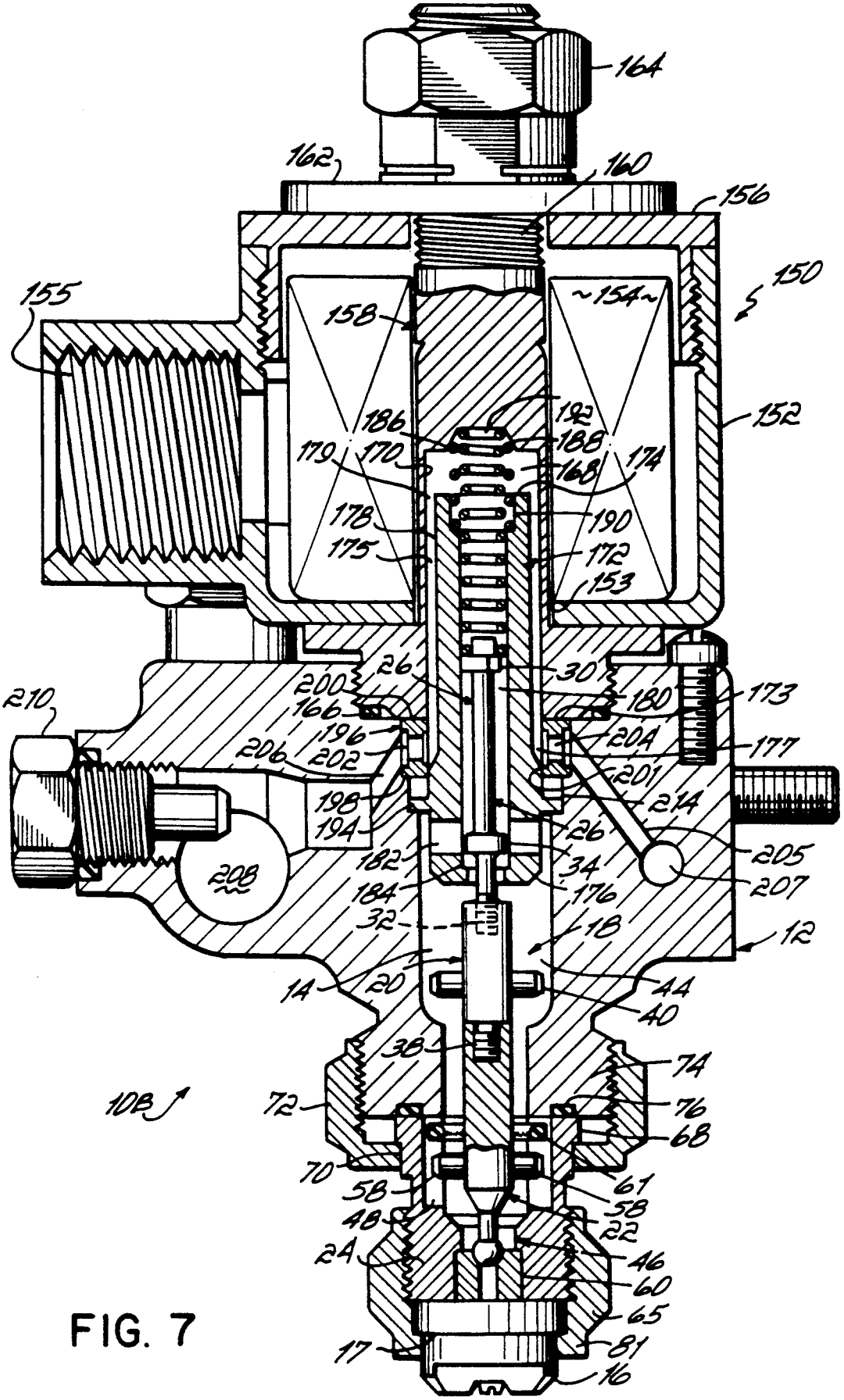
FIG. 7 is an assembled elevational view, in partial cross section, of a spray gun including an hydraulic-assisted valve closure construction wherein the valve is shown in the closed position.
Figure 8:
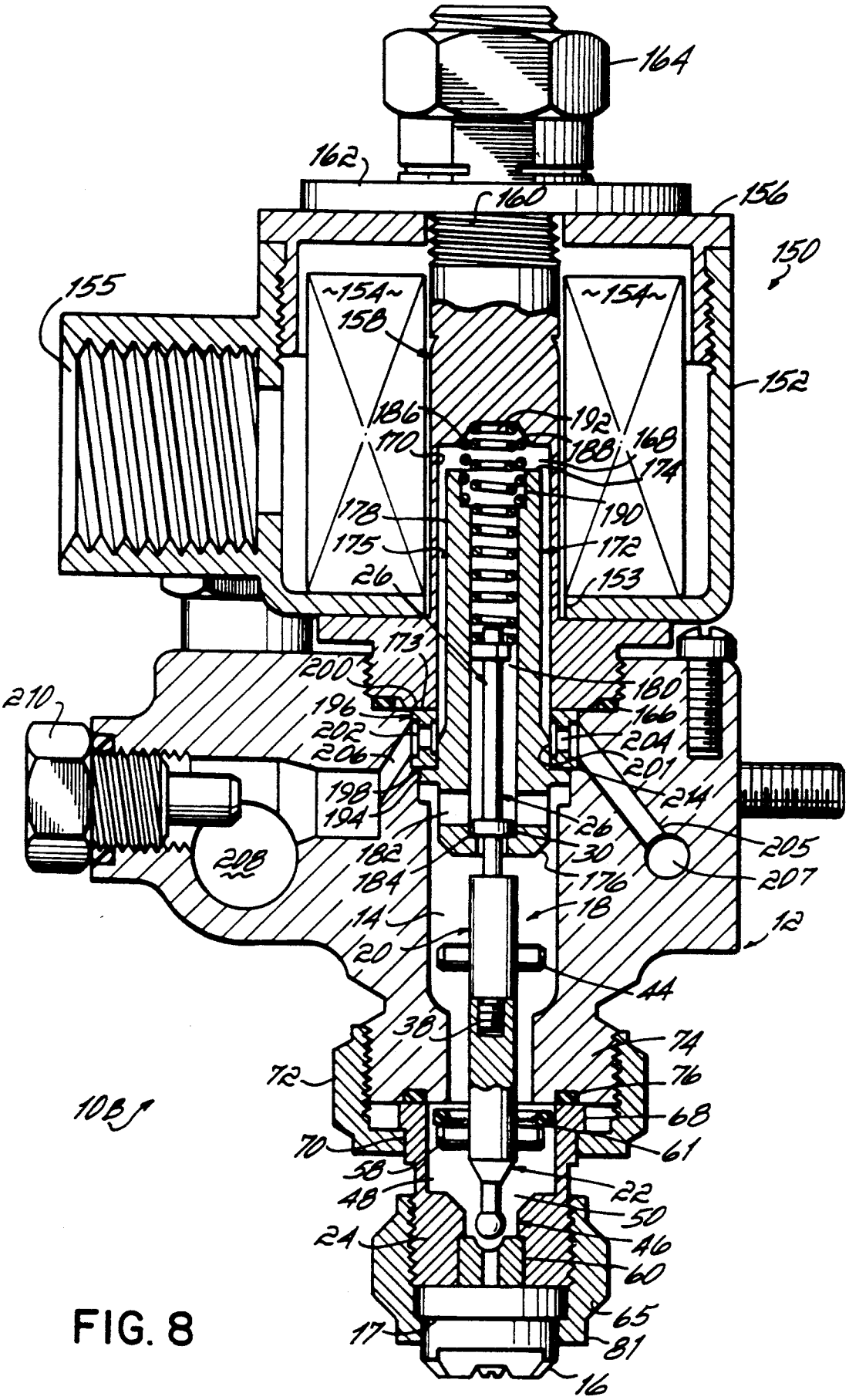
FIG. 8 is a view similar to FIG. 7 except with the valve in the open position.

The bore 180 of armature 172 receives the upper portion 26 of the valve stem 20 of needle valve 18. A radially inwardly extending flange 184 is formed at the base of armature 172 which is engageable with the sleeve 34 on the upper portion 26 of valve stem 20. As noted above, the top end of valve stem 20 is formed with a flange 30. As depicted in FIGS. 7 and 8, a compression spring 186 is located between the outer edge of a counterbore 188 formed in the armature sleeve 158 immediately above the bore 168 therein, and a seat 190 formed in the armature 172. A second compression spring 192 extends between the counterbore 188 and the flange 30 at the top of the upper portion 26 of valve stem 20.

An important aspect of the embodiment of the spray gun 10B depicted in FIGS. 7–10 is the provision of structure for hydraulically assisting the closure of needle valve 18 with respect to the valve seat 60 or 136. This structure includes an annular, armature flange 194 extending radially outwardly from the outer surface 178 of armature 172 between the inlet ends 177 of flutes 175 and the bottom end 176 of armature 172, and a fluid guide 196 carried within a recess formed in the gun body 12 in position to engage the base of armature sleeve 158 when it is assembled to the gun body 12. The fluid guide 196 is donut-shaped having a bottom surface 198 which faces the armature flange 194, a top surface 200 engageable with a base of the armature sleeve 158, a central bore defining an inner wall 201 which faces the armature 172, an inlet bore 202 and an annular groove 204 which extends between the inlet 202 and the bore 168 in the armature sleeve 158. The inlet bore 202 is connected to a passage 206 formed in gun body 12 which communicates with a coating material inlet 208 formed in the gun body 12 which mounts a fitting 210. Coating material is introduced through this inlet 208 and flows through passage 206 to the inlet 202 of fluid guide 196 and then into the annular groove 204.

The annular groove 204 of fluid guide 196 is connected to a pressure take-off passage 205 which is open to a transducer mounting passage 207 within gun body 12. A transducer (not shown) is mounted within passage 207 to sense and transmit a pressure signal indicative of the pressure of the coating material flowing through the spray gun 10B. The structure and operation of the transducer forms no part of this invention and is discussed in detail in U.S. Pat. No. 4,430,886, owned by the assignee of this invention, the disclosure of which is incorporated by reference in its entirety herein.

Figure 9:
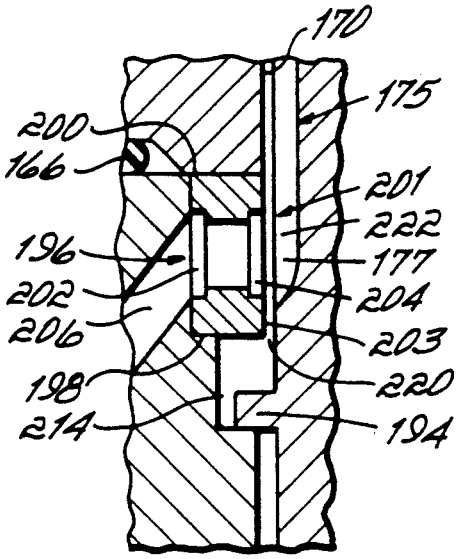
FIG. 9 is an enlarged, cross sectional view of a portion of the fluid guide herein.

As best shown in FIGS. 9 and 10, the outside diameter of armature 172 is less than that of the bore 168 in armature sleeve 158 so that a gap 212 is formed between the outer surface 178 of armature 172 and the internal wall 170 formed by the bore 168 which permits sliding movement of the armature sleeve 158 therein. Coating material is directed from the annular groove 204 in fluid guide 196 into this gap 212 and into the inlet end 177 of each flute 175. The coating material then flows in a vertically upward direction to the top end 174 of armature 172 where the coating material enters the bore 180 therein and flows vertically downwardly to the outlet passages 182 near the base of armature 172. From the passages 182, the coating material flows into the liquid passageway 14 of gun body 12 to the nozzle 16.

An important aspect of this invention is the provision of structure to induce this upward flow of coating material along armature 172, and substantially avoid a flow of material from the fluid guide 196 downwardly, directly into the liquid passageway 14 of gun body 12. With reference to FIGS. 9 and 10, it is observed that the fluid guide 196 is located relative to the armature 172 with the needle valve 18 in a closed position such that a lower portion 203 of the inner wall 201 of fluid guide 196 is located at least partially beneath the inlet end 177 of each flute 175. The remainder of the fluid guide 196, including its annular groove 204, is located at or vertically above the inlet end 177 of each flute 175. As depicted in FIG. 9, the diametral clearance 220 and associated cross sectional flow area between the lower portion 203 of inner wall 201 and the outer surface 178 of armature 172 is less than the diametral clearance 222 and associated cross sectional flow area of the annular groove 204 of fluid guide 196 coupled with the cross sectional flow area of the inlet end 177 of each flute 175 in armature 172. Because the diametral clearance 220 and its associated cross sectional flow area below the annular groove 204 is small compared to the diametral clearance 222 and its associated cross sectional flow area, the coating material discharged from groove 204 takes the path of least resistance and is induced to flow upwardly along the flutes 175 and along the gap 212 between the armature sleeve 158 and armature 172 toward the top of armature 172.

In one presently preferred embodiment, the dimensions of the aforementioned elements are given below for purposes of illustrating the comparative diametral clearances between the fluid guide 196 and armature 172:

| Element | Dimensions (Inches) |
|---|---|
| Armature Sleeve I.D. | .4495 |
| Armature O.D. | .4375 |
| Diametral Clearance 212 | .0120 |
| Fluid Guide I.D. | .4520 |
| Flute Dimensions | .035 - depth<br>.062 - width |
| Diametral Clearance 220 | .0145 |
| Diametral Clearance 222 | .0495 |

Using the dimensions given above, the flow area associated with the diametral clearance 220 between the lower portion 203 of the inner wall of the fluid guide 196 and the outer surface 178 of armature 172 is calculated as follows:

$$\begin{aligned} \text{Flow Area} &= A_1 - A_2 \\ &= \frac{\pi D_1^2}{4} - \frac{\pi D_2^2}{4} \\ &= \frac{\pi(.452)^2}{4} - \frac{\pi(.4375)^2}{4} \\ &= .1605 - .1503 \\ &= .0102 \text{ square inches} \end{aligned} \quad (1)$$

Where:

$A_1$=Fluid Guide Cross Sectional Area
$A_2$=Armature Cross Sectional Area
$D_1$=Fluid Guide I.D.
$D_2$=Armature O.D.

The flow area associated with the diametral clearance 222 between the fluid guide 196 and the armature 172 at the inlet end 177 of each flute 175 can be approximately calculated as follows:

$$\begin{aligned} \text{Flow Area} &= A_1 - A_2 + A_3 \\ &= \frac{\pi D^2}{4} - \frac{\pi D^2}{4} + 4\left[\frac{\pi R^2}{2}\right] \\ &= \frac{\pi(.452)^2}{4} - \frac{\pi(.4375)^2}{4} + 4\left[\frac{\pi(.035)^2}{2}\right] \\ &= .1605 - .1503 + .0077 \\ &= .0179 \text{ square inches} \end{aligned} \quad (2)$$

Where:

$A_1$=Fluid Guide Cross Sectional Area
$A_2$=Armature Cross Sectional Area
$A_3$=Flutes 175 Cross Sectional Area
$D_1$=Fluid Guide I.D.
$D_2$=Armature O.D.
r=Depth of Flutes 175

Because the larger flow area of 0.0179 square inches is available above the lower portion 203 of fluid guide 196, the coating material travels upwardly from the annular groove 204 in fluid guide 196 into and along the flutes 175 instead of downwardly toward the liquid passageway 14.

The above-described flow of coating material from the gun body material inlet 208 to the nozzle 16 is important to the closure of the needle valve 18 during operation of spray gun 10B. Referring initially to FIG. 8, the needle valve 18 is shown in the open position with respect to the valve seat 60 or 136 within the valve seat block 24. Movement of the needle valve 18 to this open position is achieved by supplying power to the coil 154 of solenoid 150. This causes the armature 172 to be pulled vertically upwardly so that its lower lip or flange 184 engages the sleeve 34 in the upper portion 26 of valve stem 20. This, in turn, pulls the valve stem 20 vertically upwardly causing the valve tip 22 to disengage the valve seat 60. After the valve tip 22 disengages the valve seat 60, the armature flange 194 engages and forms a metal-to-metal seal against the bottom surface 198 of fluid guide 196. As a result of this metal-to-metal seal, and the presence of the fluid guide 196 as discussed above, the coating material introduced through the material inlet 208 and passage 206 of gun body 12 is discharged from the annular groove 204 of fluid guide 196 and flows upwardly along the flutes 175 formed in the armature 176 and within the gap 212 between the armature 172 and inner wall 170 of armature sleeve 158. The coating material then moves across the top end 174 of armature 172 and enters its throughbore 180 where it travels vertically downwardly and is emitted from the outlet passages 182 near the base of armature 172. The liquid coating material enters the passageway 14 in gun body 12 from the outlet passages 182 in armature 172 where it travels through the valve seat 60 into the nozzle 16 for discharge onto the interior of a can body or the like.

In order to return the needle valve 18 to a closed position, depicted in FIG. 7, the coil 154 of solenoid 150 is first de-energized. This allows the compression spring 186 to act on armature 172 and bias it vertically downwardly within passageway 14 so that the armature flange 194 moves toward the base of the stepped bore 214 in gun body 12 and so that the flange 184 of armature 172 disengages the sleeve 34 in the upper portion 26 of valve stem 20. Simultaneously, the compression spring 192 acts on the flange 30 at the top of the upper portion 26 of valve stem 20 to urge the needle valve 18 vertically downwardly so that the valve tip 22 or extension 126 engages the valve seat 60 or 136.

An important aspect of this invention is that the downward force exerted by springs 186, 192 on the armature 172 and needle valve 18, respectively, is augmented by the hydraulic force of the coating material flowing within the flow path 212. The coating material is supplied to the spray gun 10B under pressure, e.g., on the order of 1500 psi. This hydraulic pressure is used to create a downwardly directed hydraulic force on both the armature 172 and needle valve 18. Once power to the solenoid 150 is interrupted, the coating material present within the passage 206, fluid guide 196, flutes 175 and gap 212 is maintained under pressure thereat because of the difference in the diametral clearances 220 and 222 between the fluid guide 196 and armature 172. That is, as discussed above, a larger flow area is provided between the fluid guide 196 and armature 172 at the inlet end 177 of each flute 175 than below the flutes 175 where the lower portion 203 of fluid guide 196 faces the outer surface 178 of armature 172. This induces the coating material to remain in place along the upper portion of armature 172, rather than escaping downwardly into the liquid passageway 14 of gun body 12, and, therefore, the pressure of the coating material is made available to exert a downward force at the top of the armature 172 and the top of needle valve 18. This hydraulic force assists the spring force exerted by springs 186, 192 to move both the armature 172 and needle valve 18 downwardly so the flow of coating material to the nozzle 16 is terminated. As a result, the needle valve 18 is rapidly closed to substantially prevent the leakage or drool of coating material from the nozzle 16.

While the invention has been described with reference to a preferred embodiment and one alternate embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best and alternate modes contemplated for carrying out this invention, but that the invention will include all embodiments falling within the scope of the appended claims.

We claim:

1. A spray gun, comprising:

a gun body formed with an inner passageway, said gun body including a fluid inlet having an inlet end communicating with said passageway and a fluid outlet for discharging fluid from said gun body;

a valve carried within said passageway, said valve having a first end, and a second end which is movable with respect to said fluid outlet between an open position wherein said second end engages said fluid outlet and a closed position wherein said second end disengages said fluid outlet;

a solenoid mounted to said gun body, said solenoid being formed with a passageway defining an internal wall;

said solenoid including an armature, said armature having an outer surface formed with material transfer means for transmitting said fluid and a bore which receives said first end of said valve, said armature being carried within said passageway of said solenoid so that a flow path is formed between said material transfer means in said outer surface of said armature and said internal wall of said passageway;

said solenoid being effective when energized to move said armature in a first direction, said armature including means engageable with said valve to move said valve in said first direction to said open position;

return means, acting on at least one of said armature and said valve, for moving said armature and said valve in a second direction so that said valve moves toward said closed position in response to de-energization of said solenoid;

flow control means positioned between said outer surface of said armature and said outlet end of said fluid inlet for causing the fluid to be substantially confined within said flow path and directed into said bore of said armature, the fluid being effective to exert a force against said armature and against said first end of said valve in said second direction to assist said return means in the movement of said valve to said closed position;

said flow control means defining a fluid flow path between said fluid inlet and said fluid transfer means and said flow control means restricting fluid flow between said flow control means and said armature in a position spaced from said material transfer means.

2. The spray gun of claim 1 in which said return means comprises a first spring positioned within said solenoid to exert a force in said second direction on said armature, and a second spring positioned within said solenoid to exert a force in said second direction on said valve.

3. A spray gun, comprising;

a gun body formed with an inner passageway, said gun body including a fluid inlet having an inlet end communicating with said passageway and a fluid outlet for discharging fluid from said gun body;

a valve carried within said passageway, said valve having a first end, and a second end which is movable with respect to said fluid outlet between an open position wherein said second end engages said fluid outlet and a closed position wherein said second end disengages said fluid outlet;

a solenoid mounted to said gun body, said solenoid being formed with a passageway defining an internal wall;

said solenoid including an armature, said armature having an outer surface formed with material transfer means for transmitting said fluid and a bore which receives said first end of said valve, said armature being carried within said passageway of said solenoid so that a flow path is formed between said material transfer means in said outer surface of said armature and said internal wall of said passageway;

said solenoid being effective when energized to move said armature in a first direction, said armature including means engageable with said valve to move said valve in said first direction to said open position;

return means, acting on at least one of said armature and said valve, for moving said armature and said valve in a second direction so that said valve moves toward said closed position in response to de-energization of said solenoid;

flow control means positioned between said outer surface of said armature and said outlet end of said fluid inlet for causing the fluid to be substantially confined within said flow path and directed into said bore of said armature, the fluid being effective to exert a force against said armature and against said first end of said valve in said second direction to assist said return means in the movement of said valve to said closed position;

said armature having a top end and a bottom end, said material transfer means comprising at least one flute extending radially inwardly from said outer surface of said armature, said at least one flute having n inlet end spaced from said bottom end of said armature and an outlet end at said top end of said armature.

4. The spray gun of claim 3 in which said flow control means comprises a fluid guide carried by said gun body in a position between said inlet end of said fluid inlet in said gun body and said outer surface of said armature, said fluid guide having an inner wall which faces said outer surface of said armature and an annular groove extending radially inwardly from said inner wall, at least a portion of said inner wall of said fluid guide being located between said inlet end of said at least one flute and said bottom end of said armature to create a flow restriction between said fluid guide and said armature thereat so that fluid entering said fluid guide is directed from said annular groove thereof into said at least one flute toward said outlet end of said flute.

5. The spray gun of claim 4 in which said armature is formed with an annular flange positioned between said inlet end of said at least one flute and said bottom end of said armature, said annular flange being engageable with said fluid guide with said valve in an open position to create a fluid seal therebetween.

6. A spray gun, comprising:

a gun body formed with an inner passageway, said gun body including a fluid inlet having an inlet end communicating with said passageway and a fluid outlet for discharging fluid from said gun body;

a valve carried within said passageway, said valve having a first end, and a second end which is movable with respect to said fluid outlet between an open position wherein said second end engages said fluid outlet and a closed position wherein said second end disengages said fluid outlet;

a solenoid mounted to said gun body, said solenoid being formed with a passageway defining an internal wall;

said solenoid including an armature, said armature having an outer surface formed with material transfer means for transmitting said fluid and a bore which receives said first end of said valve, said armature being carried within said passageway of said solenoid so that a flow path is formed between said material transfer means in said outer surface of said armature and said internal wall of said passageway;

said solenoid being effective when energized to move said armature in a first direction, said armature including means engageable with said valve to move said valve in said first direction to said open position;

return means, acting on at least one of said armature and said valve, for moving said armature and said valve in a second direction so that said valve moves toward said closed position in response to de-energization of said solenoid;

flow control means positioned between said outer surface of said armature and said outlet end of said fluid inlet for causing the fluid to be substantially confined within said flow path and directed into said bore of said armature, the fluid being effective to exert a force against said armature and against said first end of said valve in said second direction to assist said return means in the movement of said valve to said closed position;

wherein said gun body includes:

a valve seat block formed with a discharge bore having an inlet and an outlet, said valve seat block carrying a valve seat located at said outlet to said discharge bore i said valve seat block;

said valve being formed with a valve stem carried within said bore of said armature, and a valve tip carried within said discharge bore in said valve seat block means for interconnecting said valve stem and said valve tip so that said valve tip and said valve seat block can be simultaneously connected to said gun body in a position wherein said passageway of said gun body communicates with said discharge bore in said valve seat block, and so that said valve tip and said valve seat block can be simultaneously disconnected from said gun body.

7. A spray gun, comprising:

a gun body formed with a passageway defining an internal wall, said passageway having an inlet for receiving flowable material and a discharge outlet for discharging the flowable material;

a valve carried within said passageway, said valve having a first end, and a second end which is movable with respect to said discharge outlet of said passageway between an open position wherein said second end engages said discharge outlet and a closed position wherein said second end disengages said discharge outlet;

a solenoid including an armature sleeve mounted to said gun body, said armature sleeve being formed with a bore defining an internal wall, a closed end and an open end;

an armature formed with an outer surface, a first end, a second end and a bore extending between said first and second ends, said armature being formed with at least one flute extending radially inwardly from said outer surface, said at least one flute having an inlet end spaced from said second end of said armature and an outlet end at said first end of said armature, said armature being carried within said bore of said armature sleeve in position so that said first end of said valve extends into said open end of said bore of said armature and so that a flow path is formed between said at least one flute in said outer surface of said armature and said internal wall of said armature sleeve;

said solenoid being effective when energized to move said armature in said first direction, said armature including means engageable with said valve to move said valve in said first direction to said open position;

return means, acting on said first end of said armature and said first end of said valve, for moving said armature and said valve in a second direction so that said valve moves toward said closed position in response to de-energization of said solenoid;

a fluid guide carried by said gun body in a position between said inlet of said passageway in said gun body and said outer surface of said armature, said fluid guide having an inner wall which faces said outer surface of said armature and an annular groove extending radially inwardly from said inner wall, at least a portion of said inner wall of said fluid guide being located between said inlet end of said at least one flute and said bottom end of said armature to create a flow restriction between said fluid guide and said armature thereat so that coating material entering said inlet of said fluid guide is directed from said annular groove thereof into said at least one flute toward said outlet end thereof, the flowable material being effective to exert an hydraulic force in said second direction against said first end of said armature and against said first end of said valve to assist said return means in moving said valve to said closed position.

8. The spray gun of claim 7 in which said armature is formed with an annular flange positioned between said inlet end of said at least one flute and said bottom end of said armature, said annular flange being engageable with said fluid guide with said valve in an open position to create a fluid seal therebetween.

9. The spray gun of claim 7 in which said return means comprises a first spring and a second spring each located within said bore of said armature sleeve, said first spring extending between said closed end of said bore and said armature, said second spring extending between said closed end of said bore and said first end of said valve, said first and second springs exerting a force in said second direction on said armature and valve, respectively.

10. The method of operating a spray gun, comprising:

energizing a solenoid to move an armature, and a valve carried within a bore formed in the armature, in a first direction so that the valve disengages a valve seat at the discharge outlet of a passageway formed in the spray gun;

transmitting liquid material under the pressure through flow control means along a flow path extending from an inlet in the gun body, over one end of the armature and into the bore formed in the armature onto one end of the valve carried therein, the liquid material flowing through the armature bore and being emitted into the passageway in the spray gun for discharge through the discharge outlet thereof;

deenergizing the solenoid while said flow control means simultaneously substantially prevents the escape of the pressurized liquid material from said flow path, by directing liquid material through a flow control means along said flow path and at the same time, with said flow control means, reducing flow of liquid material outside said flow path, the liquid material thereby being induced to exert an hydraulic force which acts in a second direction opposite to said first direction against said one end of said armature and said one end of said valve to at least assist in moving said valve into engagement with the discharge outlet of the passageway in the gun body.

11. The method of claim 10 in which said step of de-energizing the solenoid includes allowing spring means to exert a force in said second direction against the armature and against the valve to assist said hydraulic force in moving the valve into engagement with the discharge outlet of the passageway in the gun body.

12. The method of claim 10 in which said step of de-energizing the solenoid and substantially preventing the escape of pressurized liquid comprises creating a flow restriction with said flow control means between said inlet of said gun body and said discharge outlet thereof so that the pressurized liquid material is induced to flow into the bore of the armature instead of toward said discharge outlet.

13. A spray gun, comprising:

a gun body formed with an inner bore having a fluid inlet and a fluid outlet;

a valve carried within said bore and operable to open and close said fluid outlet;

an armature having upper and lower ends and an outer surface, said armature disposed within said bore and operably connected to said valve to move said valve between open and closed positions, said fluid inlet being disposed between said upper and lower ends of said armature; and, flow control means disposed between said fluid inlet and said bore for directing fluid toward upper end of said armature, said flow control means having a lower surface positioned circumferentially closer to an adjacent outer surface portion of said armature than upper surfaces of said flow control means are to an adjacent outer surface portion of said armature thus creating a fluid path of lesser resistance in a direction toward the upper end than in a direction toward the lower end of the armature whereby fluid pressure exerted on said upper end assists in moving said armature in a downward direction to close said valve.

14. A spray gun, comprising:

a gun body formed with an inner bore having a fluid inlet and a fluid outlet, said fluid inlet having an inlet end communicating with the outside of said gun body and an outlet end communicating with the bore of said gun body;

a valve carried within said bore and operable to open and close said fluid outlet;

an armature having upper and lower ends and an outer surface, said armature disposed within said bore and operably connected to said valve to move said valve between open and closed positions, said outlet end of said fluid inlet being disposed between said upper and lower ends of said armature; and, flow control means disposed between said outlet end of said fluid inlet and said bore for creating a fluid path of lesser resistance in a direction toward the upper end than in a direction toward the lower end of the armature thereby directing substantially all fluid toward said upper end of said armature.

* * * * *